US007514675B2

(12) United States Patent
Yamaguchi

(10) Patent No.: US 7,514,675 B2
(45) Date of Patent: Apr. 7, 2009

(54) MASS SPECTROMETER

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 239 days.

(21) Appl. No.: 11/730,621

(22) Filed: Apr. 3, 2007

(65) Prior Publication Data

US 2007/0228270 A1 Oct. 4, 2007

(30) Foreign Application Priority Data

Apr. 4, 2006 (JP) ..... 2006-102671

(51) Int. Cl.
*H01J 49/40* (2006.01)

(52) U.S. Cl. ..... 250/287

(58) Field of Classification Search ..... 250/287
See application file for complete search history.

(56) References Cited

U.S. PATENT DOCUMENTS

| | | | | |
|---|---|---|---|---|
| 6,906,321 | B2 * | 6/2005 | Yamaguchi | 250/287 |
| 7,211,792 | B2 * | 5/2007 | Yamaguchi et al. | 250/287 |
| 7,361,889 | B2 * | 4/2008 | Yamaguchi | 250/287 |
| 7,385,187 | B2 * | 6/2008 | Verentchikov et al. | 250/287 |

FOREIGN PATENT DOCUMENTS

| | | | |
|---|---|---|---|
| JP | 2005-078987 | A | 3/2005 |
| JP | 2005-079037 | A | 3/2005 |

* cited by examiner

*Primary Examiner*—Kiet T Nguyen
(74) *Attorney, Agent, or Firm*—Westerman, Hattori, Daniels & Adrian, LLP.

(57) ABSTRACT

The present invention provides a single set of mass spectrometer capable of selectively performing the following two modes of analyses according to the purpose of analysis: the first mass spectrometry mode in which the analysis can be repeated at short intervals of time; and the second mass spectrometry mode in which the analysis can be performed with high mass resolution and high accuracy. In an embodiment of the present invention, ions ejected from an ion source 1 travel along a straight path B, on which gate electrodes 3 are provided. When a voltage is applied from an MS mode selection controller 7 to the gate electrodes 3, the ions are introduced into a loop orbit A. Located on the loop orbit A is a second ion detector 6, which is a nondestructive type of ion detector. Detection signals of the second ion detector 6 are sent to a data processor 9, which extracts flight time spectrum data from those signals and Fourier-transforms those data to convert the time axis to a frequency axis. From the frequency spectrum thus created, the mass-to-charge ratio of each ion is calculated with high accuracy. When no voltage is applied to the gate electrodes 3, the ions ejected from the ion source 1 travel along the straight path B and arrive at a first ion detector 5. This mode of analysis requires only a short period of time and can achieve a high level of time resolution.

5 Claims, 2 Drawing Sheets

MASS SPECTROMETER

The present invention relates to a mass spectrometer. More specifically, it relates to a mass spectrometer having a mass-separating section for giving an initial kinetic energy to ions and temporally separating the ions according to their mass-to-charge ratios while the ions are traveling through a flight space.

BACKGROUND OF THE INVENTION

In general, a time of flight mass spectrometer has a flight space in which neither electric nor magnetic field is present. Into this space, ions that have been given an initial kinetic energy by an electric field are introduced, and the flight time of each ion is measured until it reaches an ion detector. Based on this flight time, various ion species are separated with respect to their mass-to-charge ratios. To improve the mass resolution of this type of mass spectrometer, it is preferable to make the flight distance of the ions as long as possible. However, if the flight space is straight, it is often difficult to linearly extend the flight distance due to the limited overall size of the apparatus and other factors. To address this problem, various structures for increasing the effective flight distance have been proposed.

For example, Japanese Unexamined Patent Application Publication No. 2005-78987 discloses a mass spectrometer having multiple electric fields arranged to form a closed-loop or spiral (pseudo-loop) orbit, such as a circular orbit or an "8"-shaped orbit. Ions are introduced into this orbit and fly along the orbit multiple times until they are separated according to their mass-to-charge ratios. Finally, the separated ions are detected by the ion detector. However, the flight time thereby measured has some errors resulting from various factors independent of the mass-to-charge ratio. Examples of such factors include: dispersion of the initial kinetic energy given to the ions; dispersion of the starting points of the ions; temporal change (or jitter) of each ion at the starting time; and temporal change (or jitter) of each ion at the point of detection by the ion detector. These errors will lower the analysis accuracy.

To solve this problem, the mass spectrometer disclosed in Japanese Unexamined Patent Application Publication No. 2005-79037 includes an ion detector capable of measuring the flight time (or elapsed time) of each turn of the ion in the loop orbit. Based on the detection signals of the ion detector, a flight time spectrum having a peak at each turn of the ion is created. Then, this spectrum data is Fourier-transformed to convert the time axis to a frequency axis. On the resultant frequency spectrum, each frequency peak corresponding to each mass-to-charge-ratio is identified to calculate the mass-to-charge ratio. In this data processing, the Fourier-transformation removes the aforementioned error factors that are independent of the mass-to-charge ratio. Therefore, the mass-to-charge ratio thereby calculated is very accurate. While the ions are flying along the loop orbit, even if one ion flying at a higher speed laps another ion flying at a lower speed due to the difference between their mass-to-charge ratios, the mass spectrometer can separately detect these ions having different mass-to-charge ratios. Thus, the measuring range of the mass-to-charge ratio is expanded.

The use of Fourier-transformation in a time of flight mass spectrometer having a loop orbit significantly enhances the accuracy and mass resolution of the analysis. However, to improve the accuracy, it is necessary to considerably increase the number of turns of each ion species. In practice, it may be 1000 turns or more, so that one cycle of analysis takes a long time. Therefore, this type of mass spectrometer is not suitable for a situation where the analysis needs to be repeated at short intervals of time. One example is an analysis using the mass spectrometer as a detector of a gas chromatograph or liquid chromatograph. In this case, the mass spectrometer needs to repeatedly analyze the sample eluting from the column of the chromatograph. If the time required for one cycle of analysis is long, the time resolution will be accordingly low and the detector may fail to detect some of the sample components.

In contrast, the normal type of time of flight mass spectrometer can repeat the analysis at much shorter intervals of time than the type having a loop orbit. Its time resolution can be set so high as to prevent the detection failure of the sample components. Moreover, as opposed to the Fourier-transformation type, the normal type directly receives (i.e. destroys) ions and has an accordingly high sensitivity, so that it can detect even a small amount of ions. However, the normal type is disadvantageous in that it is not high in analysis accuracy and mass resolution. In summary, in a mass spectrometric analysis of a sample eluting from a chromatograph, if it is necessary to avoid the detection failure of the sample components and also perform a high resolution analysis of some specific components, the same sample must be measured twice using different systems, which consumes time and labor.

To solve this problem, the present invention provides a mass spectrometer capable of appropriately switching its mass-analyzing operation between the first mode having high time resolution and the second mode having high mass resolution and high accuracy.

SUMMARY OF THE INVENTION

Thus, the mass spectrometer according to the present invention includes:

a) an ion source for ejecting ions to be analyzed, from which the ions start their flight;

b) a first flight space for temporally separating the ions according to their mass-to-charge ratios during their flight;

c) a first detector for detecting the ions coming from the first flight space;

d) a second flight space for making the ions repeatedly fly along a substantially the same loop orbit multiple times;

e) a flight path selector, located on the flight path within the first flight space, for changing the flight path of the ions so that the ions coming from the ion source are selectively introduced into the second flight space;

f) a second detector, located on the loop orbit, for detecting the ions passing therethrough while leaving a portion of the ions intact; and g) a processor for calculating the mass-to-charge ratios of the ions in one of the following two modes: the first mass spectrometry mode in which the mass-to-charge ratios are calculated from the detection result obtained with the first detector; and the second mass spectrometry mode in which the mass-to-charge ratios are calculated by a process including the steps of creating waveform data indicating the flight time for each turn of the ions on the basis of the detection result obtained with the second detector, performing a Fourier transformation for a time/frequency conversion of the waveform data, and calculating the mass-to-charge ratio of the objective ion from the frequency data.

The "ion source" in the present invention does not need to ionize the sample molecules by itself; for example, it may be an ion trap that temporarily stores ions that have been externally created and then gives the ions an initial kinetic energy so that the ions start flying.

An example of the "second detector" is a nondestructive ion detector capable of electromagnetically detecting the charge amount of an ion passing through a specific point on the loop orbit. This type of ion detector can detect ions without causing any loss of them. Therefore, in principle, it is possible to detect ions at every turn during an unlimited number of turns. Alternatively, the "second detector" may be an ion detector that consumes a portion of the passing ions while allowing the other majority portion to pass through it. In this case, the total amount of the ions gradually decreases every time they pass through the ion detector. Therefore, in principle, there is an upper limit of the number of turns. If the number of turns is smaller than the upper limit, it is possible to measure the flight time for each turn with just a single release of the ions.

In the first mass spectrometry mode of the mass spectrometer according to the present invention, the flight path selector does not introduce the ions into the loop orbit. After leaving the ion source, the ions are temporally separated according to their mass-to-charge ratios during their flight through the first flight space. As a result, different kinds of ions having different mass-to-charge ratios arrive at the first detector at different points in time. The processor receives the detection signals from the first detector and creates a flight time spectrum, which, for example, shows the time as the abscissa and the signal intensity as the coordinate. Based on each point in time at which a peak is located on the spectrum, the processor calculates the mass-to-charge ratio of each ion.

In the second mass spectrometry mode, the flight path selector introduces the ions into the loop orbit. The ions introduced into the second flight space continue their flight along the loop orbit. The second detector produces detection signals every time the ions pass through it. Based on this detection signals, the processor creates a flight time spectrum. On this spectrum, presence of an ion having a certain mass-to-charge ratio is represented by a peak located at every cycle time of the ion (i.e. the time required for the ion to make a single turn along the loop orbit). The cycle time depends on the speed of the ion. Therefore, a Fourier transformation of the waveform data of the flight time spectrum will convert the cycle time to a frequency corresponding to the mass-to-charge ratio of the ion. Even if multiple ions having different mass-to-charge ratios are mixed within the space and result in two or more peaks overlapping each other on the flight time spectrum, the Fourier transformation will yield different frequency values corresponding to the different mass-to-charge ratios. From these frequency values, the processor calculates the mass-to-charge ratio of each ion.

In the first mass spectrometry mode, through the mass resolution and the analysis accuracy are relatively low, the analysis can be repeated at short intervals of time since the flight time is relatively short. Therefore, the repetition analysis can be performed with higher time resolution. In contrast, in the second mass spectrometry mode, it is necessary to ensure a long period of time for each cycle of the analysis to increase the number of turns. Therefore, the time resolution is relatively low, although the mass resolution and the analysis accuracy are high. The mass spectrometer according to the present invention can select one of the first and second mass spectrometry modes according to necessity. For example, suppose that sample components temporally separated by a chromatograph are to be detected one after another. In this case, the first mass spectrometry mode can be selected as the basic mode to carry out the repetition analysis at high time resolution so as to prevent detection failure of the sample components. Then, at a point in time where a specific sample component comes from the column, the operation can be switched to the second mass spectrometry mode so as to analyze that component with high accuracy and high mass resolution.

Thus, the present invention provides a single set of mass spectrometer capable of selectively performing the following two modes of analyses according to the purpose of analysis: the first mode with high time resolution and high sensitivity; and the second mode with high mass resolution and high accuracy.

EXPLANATION OF THE NUMERALS

1 . . . Ions Source
2 . . . First Flight Space
3 . . . Gate Electrodes
4 . . . Second Flight Space
5 . . . First Ion Detector
6 . . . Second Ion Detector
7 . . . Mass Spectrometry (MS) Mode Selection Controller
8 . . . Loop Flight Controller
9 . . . Data Processor
10 . . . Controller
A . . . Loop Orbit
B . . . Straight Path
20 . . . Liquid Chromatograph (LC)
21 . . . Mass Spectrometer (MS)

DETAILED DESCRIPTION OF A PREFERRED EMBODIMENT

Figure 1:
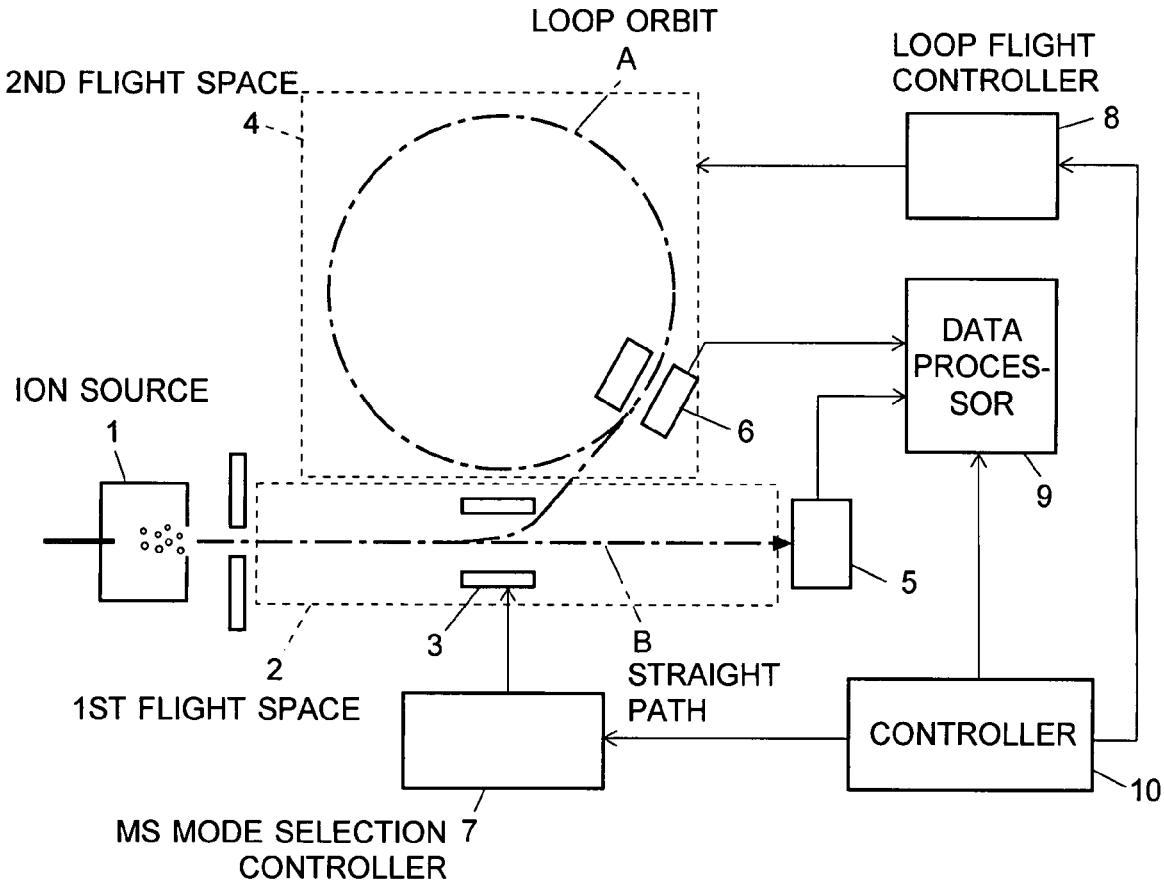
FIG. 1 is a schematic diagram of a mass spectrometer according to an embodiment of the present invention.

As an embodiment of the present invention, a mass spectrometer is described with reference to the drawings. FIG. 1 is a schematic diagram of the mass spectrometer according to the present embodiment. The loop orbit in this embodiment is circular, which is a mere example and the present invention allows the loop orbit to have an oval, "8"-shaped or any other form.

The sample molecules are ionized in the ion source 1 and then given an initial kinetic energy to be ejected from the ion source 1 into the first flight space 2. When no voltage is applied to the gate electrodes 3 inside the first flight space 2, the presence of the gate electrodes 3 is ignorable and the ions fly along the straight path B within the first flight space 2 and arrive at the first ion detector 5. This is a typical configuration of the time of flight mass spectrometer unit, where the speed of an ion is lower as the mass-to-charge ratio of the ion is larger. As a result, while traveling along the straight path B, the ions having different mass-to-charge ratios are temporally separated and arrive at the first ion detector 5.

The first ion detector 5, an example of which is a photomultiplier, produces an ion current according to the amount of the ions received. Since it does not preserve the ions, this detector can be regarded as the destructive type. The detection signals of the first ion detector 5 are sent to the data processor 9, which corresponds to the processor in the present invention. The data processor 9 creates a flight time spectrum showing the time as the abscissa and the ion intensity as the coordinate. This mode of analysis operation, in which the ions ejected from the ion source 1 travel along the straight path B and reach the first ion detector 5, is called the first mass spectrometry (MS) mode in this specification.

When a predetermined voltage is applied to the gate electrodes 3 from the MS mode selection controller 7, the ions are affected by the electric field created by the gate electrodes 3. As a result, the ions follow a curved flight path, which brings them onto the loop orbit A defined within the second flight space 4. Though not shown in FIG. 1, the second flight space 4 has several electrodes arranged inside to create multiple electric fields that define the loop orbit A. Each electrode is supplied with a voltage from the loop flight controller 8. Applying this voltage to the electrodes creates multiple electric fields that keep the ions flying along the loop orbit A.

Located in the middle of this loop orbit A is the second ion detector 6. This detector is a nondestructive detector, such as an electromagnetic induction type detector, which produces an electric signal corresponding to the amount of charged particles (i.e. ions in the present case) passing through it. Therefore, the ions flying along the loop orbit A does not experience any effect when they pass through the second ion detector 6. The detection signals of the second ion detector 6 are also sent to the data processor 9.

When the gate electrodes 3 are activated and the ions are introduced into the loop orbit A, in principle, the ions can continue flying along the loop orbit A an unlimited number of times. The second ion detector 6 produces a detection signal every time an ion passes through it. An ion having a given mass-to-charge ratio always requires the same period of time to make one turn along the loop orbit. Therefore, the detection signal of the second ion detector 6 for that ion will be produced at constant intervals of time.

Figure 4:
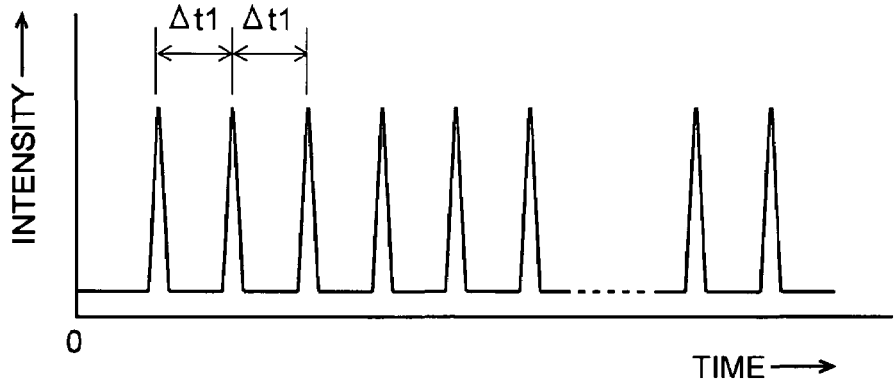
FIG. 4 is an example of the flight time spectrum obtained while ions having the same mass-to-charge ratio are flying along the loop orbit A.

FIG. 4 is an example of the flight time spectrum obtained while ions having the same mass-to-charge ratio are flying along the loop orbit A. The peak appears every time the ions pass through the second ion detector 6, and the time intervals $\Delta t1$ of those peaks are the same. This spectrum can be regarded as a signal waveform having a certain frequency f. If the time axis of the flight time spectrum data is converted to a frequency axis by Fourier transformation, the frequency spectrum thereby obtained should have a peak at the frequency f. From this frequency value f, the mass-to-charge ratio of the ion concerned can be calculated.

Figure 5:
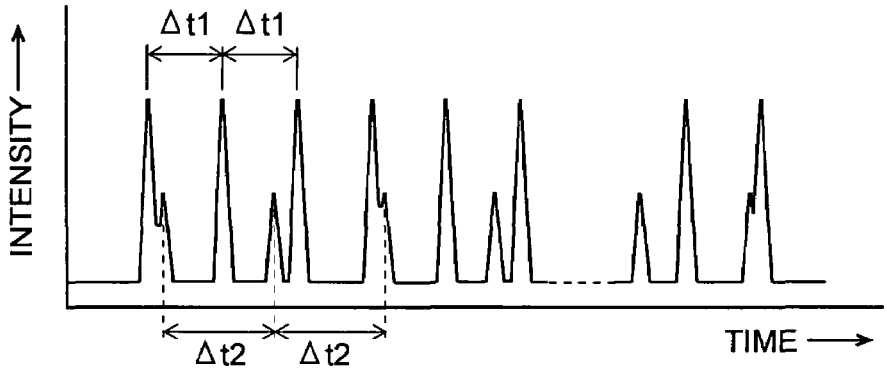
FIG. 5 is an example of the flight time spectrum obtained while two kinds of ions having different mass-to-charge ratios are flying along the loop orbit A.

An ion having a different mass-to-charge ratio will have a difference time interval of the peaks on the flight time spectrum. FIG. 5 is an example of the flight time spectrum obtained while two kinds of ions having different mass-to-charge ratios are flying along the loop orbit A. The time interval of the peaks resulting from an ion having a certain mass-to-charge ratio is denoted by $\Delta t1$ and that of the peaks resulting from another ion having a different mass-to-charge ratio is denoted by $\Delta t2$. Naturally, the two kinds of peaks sometimes overlap each other. A Fourier transformation can convert this flight time spectrum to a frequency spectrum, on which two peaks corresponding to the two different mass-to-charge ratios are separately located. From these frequency values, the mass-to-charge ratio of each ion can be calculated. This mode of analysis operation, in which the ions released from the ion source 1 are introduced into the loop orbit A and repeatedly detected by the second ion detector 6 during their flight, is called the second mass spectrometry (MS) mode in this specification.

The MS mode selection controller 7, the loop flight controller 8, the data processor 9 and other components are integrally operated by the controller 10. The functions of the data processor 9 and the controller 10 can be embodied in the form of a personal computer on which a processor/controller software program is running.

Figure 2:
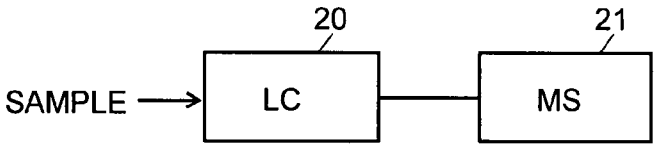
FIG. 2 shows a mode of usage of the mass spectrometer according to the embodiment.

The mass spectrometer (MS) 21 according to the present embodiment can used as the detector of a liquid chromatograph (LC) 20, as shown in FIG. 2. This system, i.e. the liquid chromatograph/mass spectrometer (LC/MS), can operate as follows:

As the time elapses from the point in time at which the sample was injected into the liquid chromatograph 20, the sample components separated from each other exit the column one after another and enter the mass spectrometer 21. Suppose that a chromatogram as indicated by (a) in FIG. 3 has been obtained from the result of detecting the sample components received from the liquid chromatograph 20 (Note: actual chromatograms can have different forms). To detect the sample components in the column elution with minimal detection failures, the cycle of analysis in the repletion analysis mode should be as short as possible. Accordingly, in the first mass spectrometry mode, the controller 10 controls the components concerned so that the analysis is repeated at short intervals of time ((b) in FIG. 3).

In the first MS mode, the MS mode selection controller 7 does not apply the voltage to the gate electrodes 3. The data processor 9 creates a flight time spectrum for each cycle of analysis on the basis of the detection signals produced by the first ion detector 5. From a series of flight time spectrums, the data processor 9 creates a mass spectrum having one or more peaks. From these peaks, the mass-to-charge ratio of each ion is derived.

During a time range in which the ions need to be observed with a particularly high accuracy and high mass resolution, the apparatus should switch to the second MS mode. Then, under the command of the controller 10, the MS mode selection controller 7 applies the voltage to the gate electrodes 3 at a point in time where the ion to be observed with high mass resolution (i.e. the ion corresponding to the peak P on the chromatogram) is released from the ion source 1. As a result, that ion arriving at the gate electrodes 3 is brought into the loop orbit A. At the same time, the loop flight controller 8 creates the aforementioned electric fields for making the ion continue flying along the loop orbit A. The data processor 9 begins the creation of flight time spectrums on the basis of the detection signals received from the second ion detector 6.

After applying the voltage to the gate electrodes 3 for a predetermined period of time, the MS mode selection controller 7 turns off the voltage so that the analysis returns to the first MS mode. Meanwhile, the ions introduced into the loop orbit A continue their flight, and the data processor 9 keeps creating the flight time spectrums. This means that the data processor 9 simultaneously carries out the processes of the first MS mode and the second MS mode, including the creation of the flight time spectrums, as can be understood from (b) and (c) in FIG. 3, where the analysis periods of the two modes are overlapped with each other. After the flight time spectrum data of a predetermined number of turns have been collected from the detection signals of the second ion detector 6, a Fourier transformation is carried out to convert the time axis to a frequency axis, whereby a frequency spectrum is created. Then, each peak on this frequency spectrum is identified and the mass-to-charge ratio of each ion is calculated from the frequency of each detected peak.

As described thus far, the LC/MS using the mass spectrometer according to the present embodiment as the detector unit can generally operate as a normal time of flight mass spectrometer to repeatedly perform the mass analysis with high time resolution and sometimes operate as a Fourier-transformation type time of flight mass spectrometer when there is a specific sample component that needs to be analyzed with high accuracy and high mass resolution.

Figure 3:
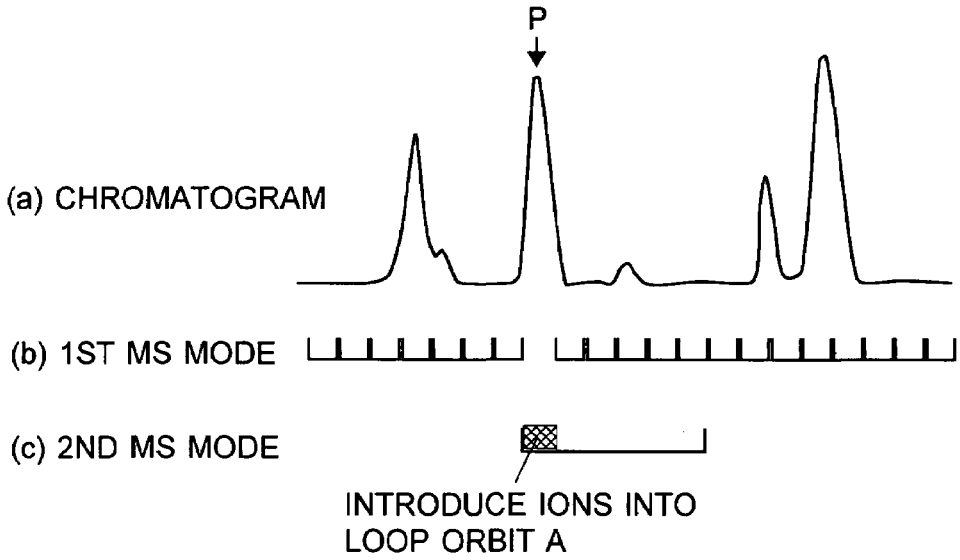
FIG. 3 illustrates an example of analysis operation by the mass spectrometer according to the embodiment.

In the case of the construction shown in FIG. 2, it is impossible to visually monitor the chromatogram as shown in FIG. 3(*a*) on a screen and select the period of time for switching to the second MS mode in real time. Taking this situation into account, the apparatus may be constructed so that the eluate from the liquid chromatograph 20 is introduced into another detector, such as an ultraviolet-visible spectrophotometer, and then introduced into the mass spectrometer 21 to perform mass analysis. This construction allows users to monitor a repeatedly updated chromatogram, which is created from the detection signals of the ultraviolet-visible spectrophotometer, and enter a command for switching the analysis mode of the mass spectrometer 21 to the second MS mode when an objective peak has been detected.

The second ion detector 6 used in the previous embodiment detects the amount of the passing ions without destroying any of them. Another detector available as the second ion detector 6 uses a microchannel plate (MCP) having pores, which gradually separates a small amount of the ions at every turn. This detector is not perfectly nondestructive; the amount of the ions gradually decreases every time they pass through the detector, so that there is an upper limit of the number of turns. However, use of a MCP detector makes the detection sensitivity higher than in the case of using a perfectly nondestructive ion detector.

In the previous embodiment, the ions introduced into the loop orbit A do not return to the straight path B. It is also possible to deflect the ions off the loop orbit A after they have turned the loop orbit A multiple times and then bring them back onto the straight path B so that they can be detected by the first detector 5. In this case, the apparatus does not perform the analysis as a Fourier-transformation type mass spectrometer but a normal time of flight mass spectrometer having a loop orbit.

What is claimed is:

1. A mass spectrometer, comprising:

a) an ion source for ejecting ions to be analyzed, from which the ions start their flight;

b) a first flight space for temporally separating the ions according to their mass-to-charge ratios during their flight;

c) a first detector for detecting the ions coming from the first flight space;

d) a second flight space for making the ions repeatedly fly along a substantially a same loop orbit multiple times;

e) a flight path selector, located on the flight path within the first flight space, for changing the flight path of the ions so that the ions coming from the ion source are selectively introduced into the second flight space;

f) a second detector, located on the loop orbit, for detecting the ions passing therethrough while leaving a portion of the ions intact; and g) a processor for calculating mass-to-charge ratios of the ions in one of following two modes: a first mass spectrometry mode in which the mass-to-charge ratios are calculated from a detection result obtained with the first detector; and a second mass spectrometry mode in which the mass-to-charge ratios are calculated by a process including steps of creating waveform data indicating the flight time for each turn of the ions on a basis of a detection result obtained with the second detector, performing a Fourier transformation for a time/frequency conversion of the waveform data, and calculating the mass-to-charge ratio of an objective ion from frequency data.

2. The mass spectrometer according to claim 1, further comprising an analysis controller for carrying out mass analysis in the second mass spectrometry mode by introducing the ions into the loop orbit through the flight path selector at a specific point in time while the mass analyses in the first mass spectrometry mode are repeatedly carried out.

3. The mass spectrometer according to claim 1, wherein the ion source is an ion trap for temporarily storing externally created ions and then for giving the ions an initial kinetic energy so that the ions start flying.

4. The mass spectrometer according to claim 1, wherein the second detector is a nondestructive ion detector capable of electromagnetically detecting an amount of charge of an ion passing through a specific point on the loop orbit.

5. The mass spectrometer according to claim 1, wherein the second detector is an ion detector that consumes a portion of the passing ions while allowing another majority portion to pass through it.

* * * * *